US009315358B2

(12) United States Patent
Hashimoto

(10) Patent No.: US 9,315,358 B2
(45) Date of Patent: Apr. 19, 2016

(54) SPUN YARN WINDING DEVICE AND SPUN YARN WINDING FACILITY

(75) Inventor: Kinzo Hashimoto, Kyoto (JP)

(73) Assignee: TMT MACHINERY, INC., Osaka (JP)

( * ) Notice: Subject to any disclaimer, the term of this patent is extended or adjusted under 35 U.S.C. 154(b) by 408 days.

(21) Appl. No.: 13/978,955

(22) PCT Filed: Oct. 14, 2011

(86) PCT No.: PCT/JP2011/073724
§ 371 (c)(1),
(2), (4) Date: Jul. 10, 2013

(87) PCT Pub. No.: WO2012/096040
PCT Pub. Date: Jul. 19, 2012

(65) Prior Publication Data

US 2013/0284848 A1 Oct. 31, 2013

(30) Foreign Application Priority Data

Jan. 11, 2011 (JP) ..... 2011-003358

(51) Int. Cl.

| | |
|---|---|
| ***B65H 67/048*** | (2006.01) |
| ***B65H 63/08*** | (2006.01) |
| ***B65H 54/28*** | (2006.01) |
| ***B65H 54/38*** | (2006.01) |
| ***B65H 54/52*** | (2006.01) |
| ***B65H 54/72*** | (2006.01) |
| ***B65H 54/74*** | (2006.01) |
| ***B65H 61/00*** | (2006.01) |

(52) U.S. Cl.
CPC ..... *B65H 67/048* (2013.01); *B65H 54/28* (2013.01); *B65H 54/385* (2013.01); *B65H 54/52* (2013.01); *B65H 54/72* (2013.01); *B65H 54/74* (2013.01); *B65H 61/005* (2013.01); *B65H 63/082* (2013.01); *B65H 2701/31* (2013.01); *B65H 2701/319* (2013.01)

(58) Field of Classification Search
CPC ..... B65H 67/048; B65H 2701/319
See application file for complete search history.

(56) References Cited

U.S. PATENT DOCUMENTS 4,948,058 A * 8/1990 Behrens ..... B65H 54/72 242/474.6

FOREIGN PATENT DOCUMENTS

| | | | |
|---|---|---|---|
| EP | 0 927 694 | A2 | 7/1999 |
| JP | 2-276766 | A | 11/1990 |
| JP | 11-100168 | A | 4/1999 |
| JP | 11-193179 | A | 7/1999 |
| JP | 11-314845 | A | 11/1999 |
| JP | 2001-226034 | A | 8/2001 |
| JP | 2005-225611 | A | 8/2005 |

* cited by examiner

*Primary Examiner* — William E Dondero
(74) *Attorney, Agent, or Firm* — Keating and Bennett, LLP

(57) ABSTRACT

A spun yarn winding device includes a machine body; a turret; a feeding roller that is fixed to the machine body, is not in contact with winding bobbins, and feeds yarns to the winding bobbins at a speed equal to or faster than a winding speed; a traverse device fixed at an upstream side of an advance direction of the yarns relative to the feeding roller and which traverses the yarns; a peripheral speed detection unit that detects a peripheral speed of the winding bobbins; and a control unit that is arranged and programmed to perform a basic operation to maintain a free length of the yarns at a standard length by controlling a rotational angle of a turret during a yarn winding period, the free length of the yarns being located between the feeding roller and the winding bobbins.

12 Claims, 9 Drawing Sheets

SPUN YARN WINDING DEVICE AND SPUN YARN WINDING FACILITY

BACKGROUND OF THE INVENTION

1. Field of the Invention

The present invention relates to a spun yarn winding device and a spun yarn winding facility which winds spun yarns onto winding bobbins.

2. Description of the Related Art

Conventionally, a spun yarn winding device includes a traverse device with traverse guides that reciprocate in an axial direction of winding bobbins. A contact roller which is contacted by packages is provided on a lower side of the traverse device. As the yarns are being traversed and wound around the rotating winding bobbins into the packages so as to gradually increase in winding diameter, the position of the contact roller gradually rises corresponding to the increase in winding diameter of the packages. As such, the process for raising up the traverse device together with the contact roller corresponding to the increase in winding diameter of the packages so as to make constant the position of the contact roller and the traverse device relative to the packages is publicly known (see, for example, Japanese Patent Laid Open Gazette 2005-225611).

However, yarn density may concentrate at yarn turn portions of the packages in the opposite ends of the packages, and then, a saddle bag shape phenomenon may occur, that is, the opposite ends of the packages may become higher than a central portion thereof. This saddle bag shape phenomenon may result in saddle bag shaped packages, and then, may disadvantageously prevent the line of yarns from being appropriately unwound from the packages during a post-process.

To solve this saddle bag shape phenomenon, a mechanism (saddle bag shape collapsing mechanism) which temporarily changes the distance between the traverse device and the contact roller has been disclosed in Japanese Patent Laid Open Gazette 2005-225611. The saddle bag shape collapsing mechanism largely raises up the traverse device temporarily relative to the contact roller during a packages forming period, and performs so as to temporarily increase a free length of the yarns which is placed between the traverse device and the contact roller. The operation enables a winding width to be temporarily reduced without changing the width over which the traverse guides reciprocate. Repeating the adjustment for the winding width solves the saddle bag shape phenomenon.

However, with regard to the above-mentioned conventional spun yarn winding device, it is necessary to gradually raise up the contact roller and the traverse device corresponding to the increases in winding diameter of the packages. Furthermore, to solve the saddle bag shape phenomenon of the packages, it is necessary to greatly raise up the traverse device relative to the contact roller. Because the above-mentioned conventional spun yarn winding device is provided with a movable portion projecting to an upper direction thereof, there is a problem that the device is unable to reduce the size of the spun yarn winding device in a vertical direction.

Furthermore, since the spun yarn winding device is large in size in a vertical direction, if a plurality of spun yarn winding devices is stacked toward the up/down direction in multiple stages, the height of a spun yarn winding facility becomes higher, and because of the excess height, particularly the workability for the spun yarn winding devices which are placed on the upper stage is impaired. Therefore, the plurality of spun yarn winding devices cannot be stacked in the up/down direction in multiple stages, and then, there is a problem that the space cannot be effectively utilized.

SUMMARY OF THE INVENTION

In view of the above-described problems, preferred embodiments of the present invention provide a spun yarn winding device which is compacted in the vertical direction and a spun yarn winding device which can solve the saddle bag shape phenomenon of the packages. Other preferred embodiments of the present invention provide a spun yarn winding facility which allows the plurality of spun yarn winding devices to be stacked in an up/down direction in multiple stages without impairing the workability and thus allows the space to be effectively used.

According to a first preferred embodiment of the present invention, a spun yarn winding device for winding a spun yarn onto winding bobbins includes a machine body, a turret, a feeding roller, a traverse device, a peripheral speed detection unit, and a control unit. The turret includes a bobbin holder that holds the winding bobbins and rotates with respect to the machine body. A position of the feeding roller is fixed relative to the machine body, is not in contact with the winding bobbins, and feeds the yarns to the winding bobbins at a speed equal to or faster than the speed at which the yarns is wound on the winding bobbins. A position of the traverse device is fixed at an upstream side of the advance direction of the yarns with respect to the feeding roller, and traverses the yarns. The peripheral speed detection unit detects the peripheral speed of the winding bobbins. The control unit is programmed to perform a basic operation during the yarn winding period to maintain the free length of the yarns at a standard length by controlling the rotational angle of the turret, the free length being lengths of the portions of the yarns which are located between the feeding roller and the winding bobbins.

According to a second preferred embodiment of the present invention, the feeding roller preferably feeds yarns to the winding bobbins at a speed faster than the speed at which the yarns are wound on the winding bobbins, and the control unit is programmed to repeat its basic operation and perform a change operation during the yarn winding period, wherein the change operation temporarily increases the length of the free length greater than that of the standard length.

According to a third preferred embodiment of the present invention, the peripheral speed detection unit preferably includes a contact roller which contacts with the winding bobbins under a predetermined contact pressure following a change of position of the winding bobbins.

According to a fourth preferred embodiment of the present invention, a spun yarn winding facility includes a combination of a plurality of spun yarn winding devices of any of the preferred embodiments of the present invention described above, wherein a first group of the plurality of spun yarn winding devices is located on an upper stage and a second group of the plurality of spun yarn winding devices is located on a lower stage, and each one of yarns fed to the spun yarn winding devices which are located on the lower stage passes between the plurality of spun yarn winding devices which is located on the upper stage, and then fed to the traverse device from above.

According to a fifth preferred embodiment of the present invention, a spun yarn winding facility includes a combination of a plurality of spun yarn winding devices of any of the preferred embodiments of the present invention described above, wherein a first group of the plurality of spun yarn winding devices is located on an upper stage and a second group of the plurality of spun yarn winding devices is located on a lower stage, and each one of the yarns fed to the spun yarn winding devices which are located on the upper or lower stage is fed to the traverse device from a side.

According to the spun yarn winding device of the first preferred embodiment of the present invention, a position of the feeding roller and the traverse device is fixed relative to the machine body, and corresponds to the increases in winding diameter of the packages by rotating the turret. Therefore, it is not necessary to provide a movable portion projecting in the vertical direction of the spun yarn winding device, and it is possible to reduce the size of the spun yarn winding device in a vertical direction, and thus the spun yarn winding device can be compacted.

According to the spun yarn winding device of the second preferred embodiment of the present invention, the position of the feeding roller and the traverse device is fixed relative to the machine body and conventionally, the turret is structured to rotate against the machine body. Therefore, the spun yarn winding device has a simple and highly reliable structure, and solves the saddle bag shape phenomenon of the packages. Also, the bulge winding phenomenon of the packages can simultaneously be solved since the feeding roller feeds the yarns to the winding bobbins at a speed faster than the winding speed at which the yarns are wound onto the winding bobbins.

According to the spun yarn winding device of the third preferred embodiment of the present invention, the spun yarn winding device is provided with the contact roller which is in contact with the winding bobbins under a predetermined contact pressure, following the change of the position of the winding bobbins. Since the contact roller rotates following the rotation of the winding bobbins, the peripheral speed of the winding bobbins can be detected.

According to the spun yarn winding facility of the fourth preferred embodiment of the present invention, the spun yarn winding facility includes a combination of the plurality of spun yarn winding devices wherein the spun yarn winding devices are located on both the upper and lower stages in a state of a longitudinal layout, and the spun yarn winding facility is configured so that the yarns are fed to each of the traverse devices of the spun yarn winding devices from the upper portion. Since the spun yarn winding device is compacted in a vertical direction, even if the plurality of spun yarn winding devices is stacked in the up/down direction in multiple stages in a state of a longitudinal layout, the spun yarn winding facility is compact in a vertical direction. Particularly, the workability for the spun yarn winding devices which are located on the upper stage is improved. For this reason, without impairing the workability, the plurality of spun yarn winding devices can be stacked in the up/down direction in multiple stages in a state of a longitudinal layout. As a result, the space is effectively utilized.

According to the spun yarn winding facility of the fifth preferred embodiment of the present invention, the spun yarn winding facility includes the combination of the plurality of spun yarn winding devices wherein the spun yarn winding devices are located on both the upper and lower stages in a state of a horizontal layout, and the spun yarn winding facility is configured so that the yarns are fed to each of the traverse devices of the spun yarn winding devices from the side portion. Since the spun yarn winding device is compacted in a vertical direction, even if the plurality of spun yarn winding devices is stacked in the up/down direction in multiple stages in a state of a horizontal layout, the spun yarn winding facility is compacted in the horizontal direction. For this reason, the working space which is necessary between adjacent spun yarn winding devices is ensured, and the workability for the spun yarn winding devices can be improved. For this reason, without impairing the workability, the plurality of spun yarn winding devices can be stacked in up/down direction in multiple stages in a state of horizontal layout. As a result, the space is effectively utilized.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Next, preferred embodiments of the present invention will be described with reference to drawings.

Preferred Embodiment 1

A spun yarn winding device 100 according to Preferred Embodiment 1 of the present invention will be described with reference to FIGS. 1 to 4.

Figure 1:
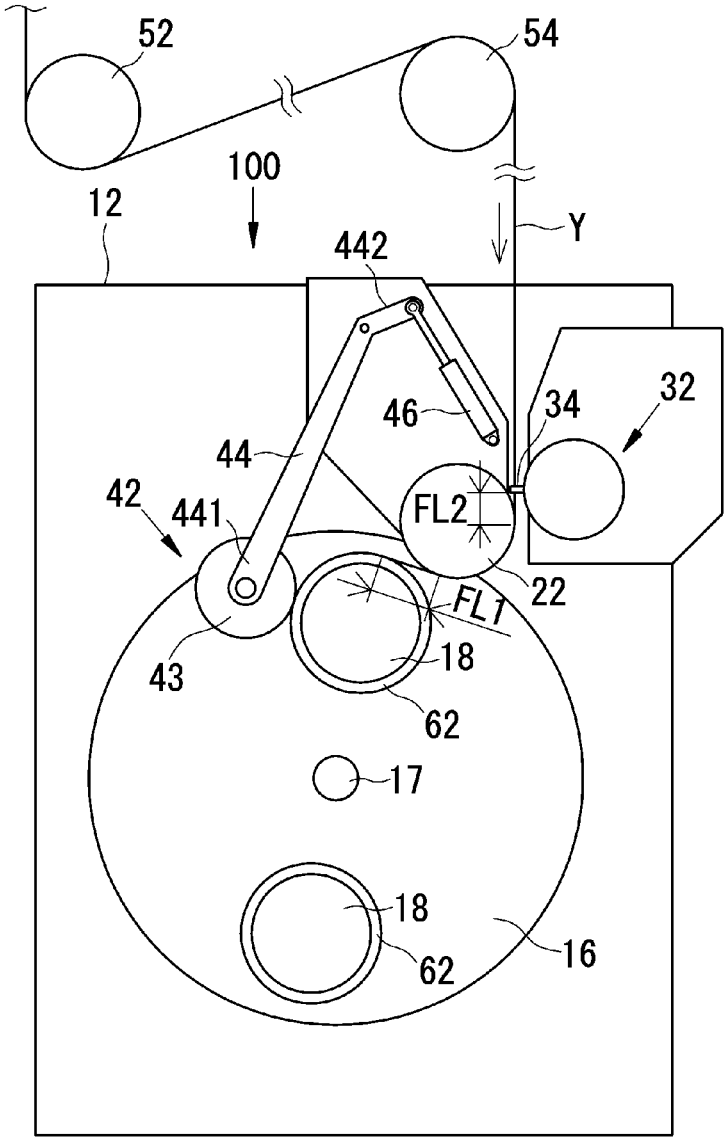
FIG. 1 is a front view showing a spun yarn winding device 100 according to Preferred Embodiment 1 of the present invention.

As shown in FIG. 1, the spun yarn winding device 100 according to the present preferred embodiment is a device for forming packages 64 by winding the yarns Y onto tubes 62 traversing the yarns Y by a traverse device 32. The yarns Y are spun from a spinning device (not shown in the drawings) which is located at an upper position, and fed to the spun yarn winding device 100 through intermediaries of a roller 52, a roller 54 and the like. As indicated by an arrow, the traveling direction of the yarns Y is a direction from the upper positioned spinning device to the winding tubes 62.

Hereinafter, the yarns Y are explained as elastic yarns. However, the spun yarn winding device 100 can also wind yarns other than the elastic yarns. Although FIG. 1 shows the single spun yarn winding device 100, a spun yarn winding facility is constituted by placing a plurality of such spun yarn winding devices 100.

Figure 4:
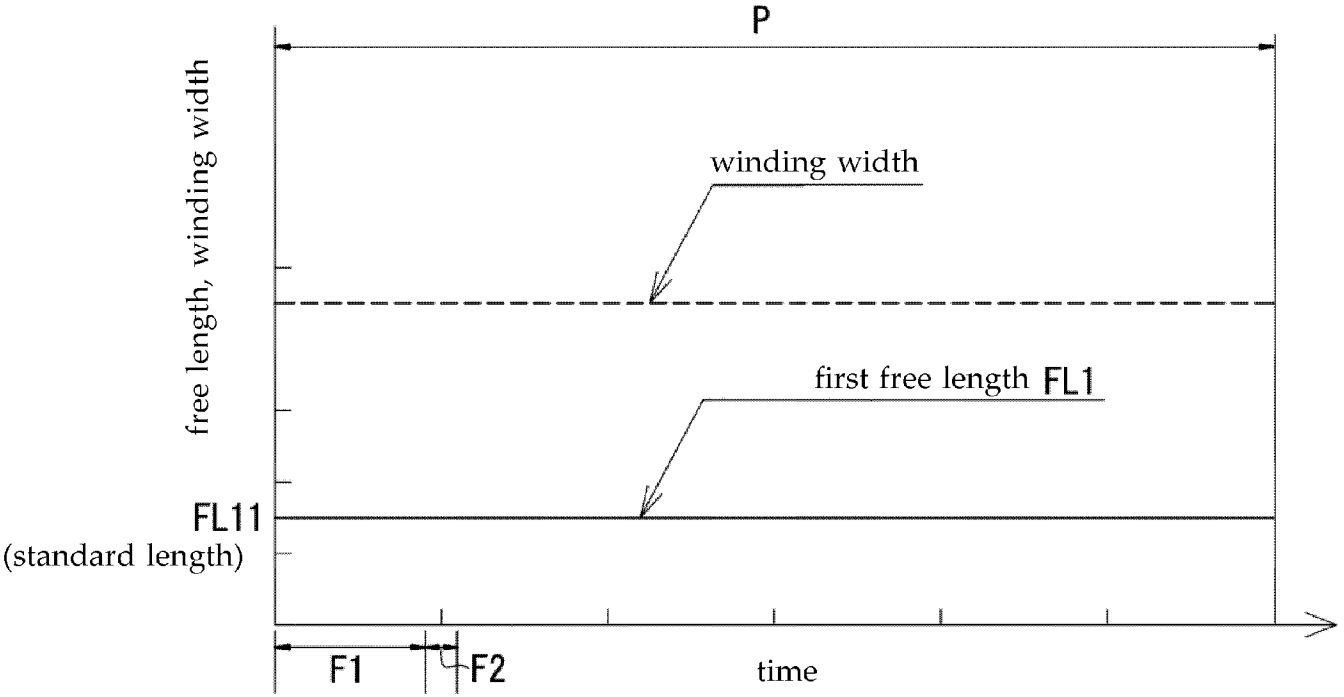
FIG. 4 is a graph showing the relation between winding width and time when the first free length FL1 is set at the standard length FL11 constantly.

Also, in the following explanation, winding bobbins B is used as a general term for the winding tubes 62 and the packages 64. That is to say, the winding bobbins B in which a yarn layer is not formed are the winding tubes 62, whereas the winding bobbins B onto which the yarn layer is formed are the packages 64. As shown in FIG. 4, packages forming a period P is defined as the period of time during winding the yarns Y to form the packages 64.

The vertical direction of the spun yarn winding device 100 is defined as a direction along the direction of the yarns Y heading for the traverse device 32. That is to say, the up/down direction on the paper surface of FIG. 1 is corresponding to the vertical direction of the spun yarn winding device 100. The lateral direction of the spun yarn winding device 100 is defined as the left/right direction of the spun yarn winding device 100 when viewed from the axial direction of a rotating shaft 17 of a turret 16. That is to say, the horizontal direction on the paper surface of FIG. 1 is corresponding to the lateral direction of the spun yarn winding device 100. Meanwhile, mounting layouts of the spun yarn winding device 100 includes a longitudinal layout and a lateral layout. The longitudinal layout is defined as a mounting layout in which the yarns Y are fed to the traverse device 32 from up to down as shown in FIG. 1 (Refer to FIG. 8). The lateral layout is defined as a mounting layout in which the yarns Y are fed to the traverse device 32 from a side portion (Refer to FIG. 9). In addition, the vertical direction and the side portion from which the yarns Y are fed does not mean the strict definition of "the up/down direction" and "the horizontal direction".

Figure 2:
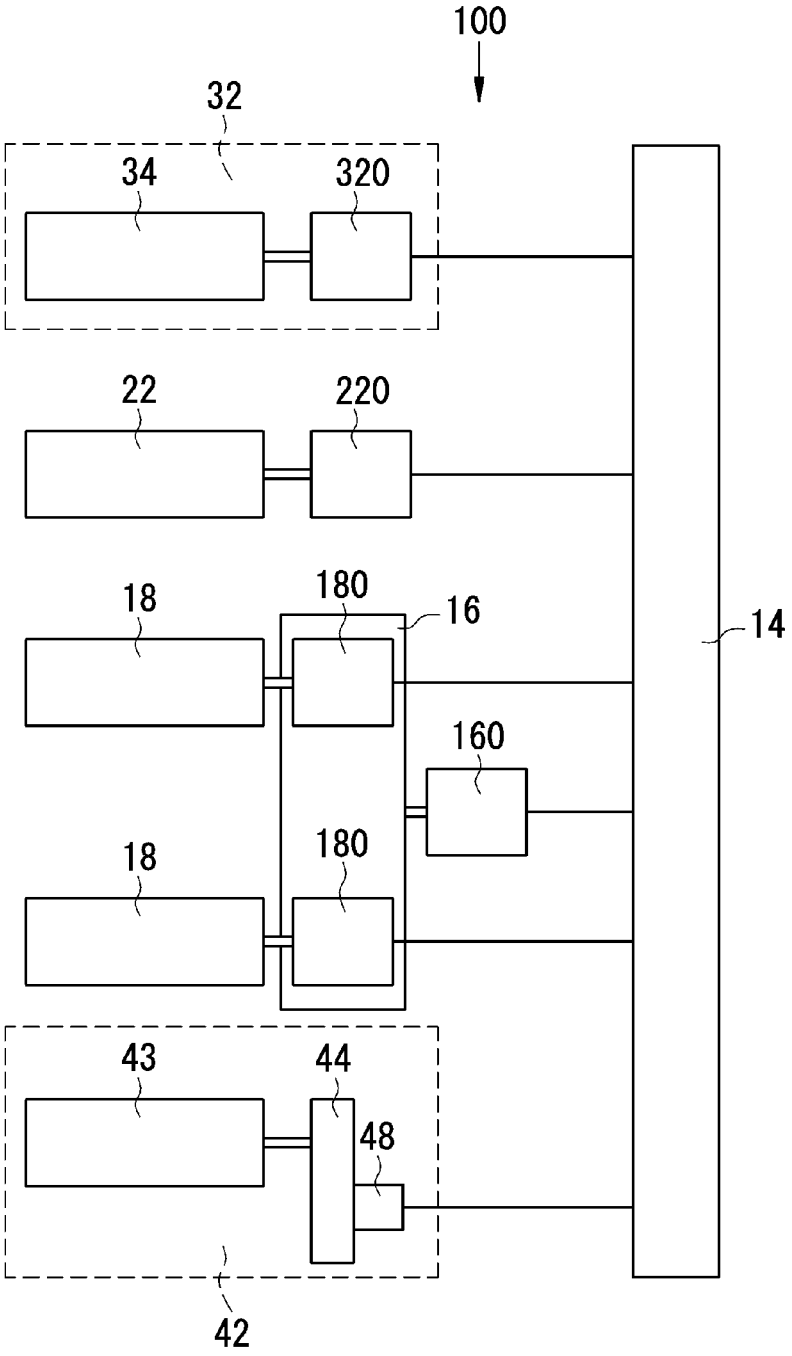
FIG. 2 is a block diagram of the spun yarn winding device 100 according to Preferred Embodiment 1 of the present invention.

As shown in FIGS. 1 and 2, the spun yarn winding device 100 preferably includes a machine body 12, a control unit 14, the turret 16, a feeding roller 22, the traverse device 32 and a peripheral speed detection unit 42. The machine body 12 is the main body of the spun yarn winding device 100. The control unit 14 preferably includes a CPU as an arithmetic unit, a ROM as a memory unit, and RAM, etc. A control software that operates the hardware such as the CPU, etc., as a control unit is stored in the ROMs. The control unit 14 controls driving of each drive motor based on signals generated by various sensors.

The turret 16 preferably includes bobbin holders 18 to hold the winding bobbins B, and rotates with respect to the machine body 12. The turret 16 is rotated around the rotating shaft 17 by a turret driving motor 160 (Refer to FIG. 2). The turret driving motor 160 is electrically connected to the control unit 14, hence driving of the turret driving motor 160 is controlled.

Two bobbin holders 18 are located at symmetrical positions with respect to the rotating shaft 17 of the turret 16. Two bobbin holders 18 are connected to respective bobbin holder driving motors 180, and are rotatable (Refer to FIG. 2). Each bobbin holder driving motor 180 is electrically connected to the control unit 14, and hence driving of the bobbin holder driving motors 180 is controlled.

The turret 16 rotates forward and backward by the forward-reversal rotation of the turret driving motor 160. Approximately half rotating the turret 16 by the turret driving motor 160 allows the positions of the two bobbin holders 18 to be changed with each other so that one of the bobbin holders 18 is located at an upper winding position, whereas the another one of the bobbin holders 18 is located at a lower standby position. Also, the positions of the winding bobbins B can be finely controlled by rotating the turret 16 through a fine angle. This can be done by controlling the rotation angle of the turret driving motor 160.

The feeding roller 22 is a roller that receives the yarns Y from the traverse device 32 and feeds the yarns Y to an outer periphery of the winding bobbins B. The feeding roller 22 is driven by a feeding roller driving motor 220. The feeding roller driving motor 220 is electrically connected to the control unit 14, hence driving of the feeding roller driving motor 220 is controlled. The rotational speed of the feeding roller 22 is equal to or faster than the speed at which the yarns Y are wound on the winding bobbins. The rotational speed of the feeding roller 22 can be changed by varying the rotation number of the feeding roller driving motors 220.

Figure 3:
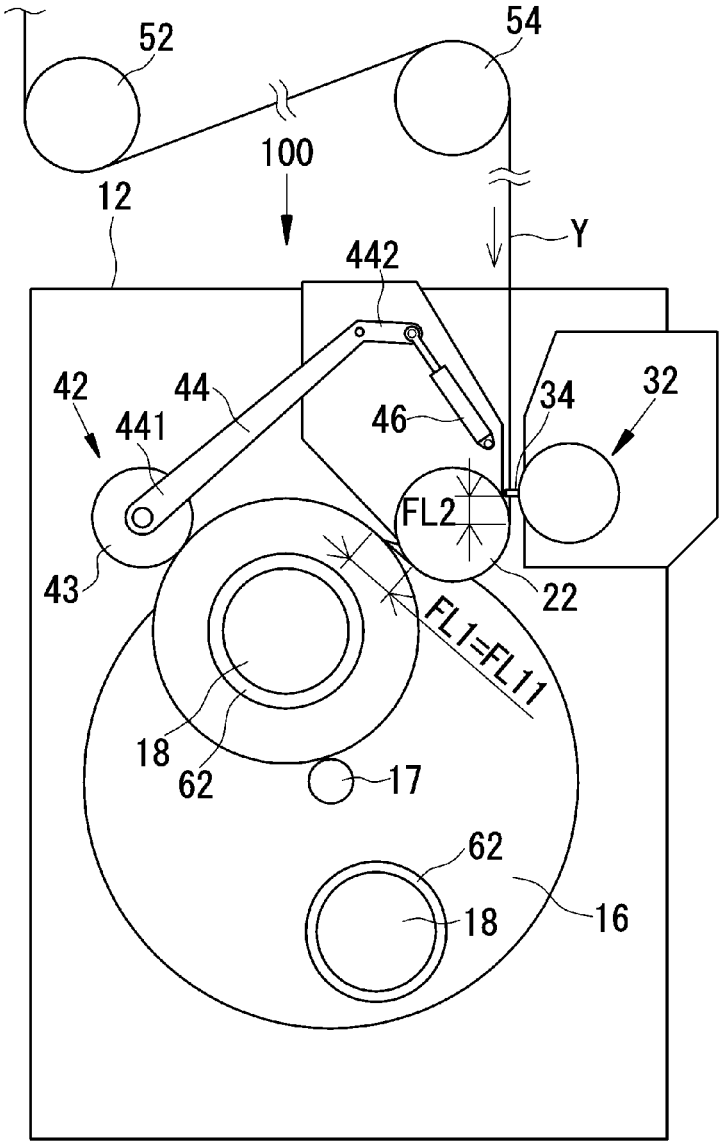
FIG. 3 is a front view showing a state performing a basic operation for maintaining a first free length FL1 at a standard length FL11.

The feeding roller 22 is fixed in a position relative to the machine body 12. Therefore, forward rotation (counterclockwise rotation in FIG. 1) of the turret 16 allows the winding bobbins B to be separated from the feeding roller 22, whereas reverse rotation (clockwise rotation in FIG. 1) of the turret 16 allows the winding bobbins B to be closer to the feeding roller 22. During the package forming period P, the interval between the feeding roller 22 and the winding bobbins B is ensured by controlling the rotation angle of the turret 16. The length of the yarns Y which runs through this interval is defined as a first free length FL1. That is to say, as shown in FIGS. 1 and 3, the first free length FL1 is the free length portion of the yarns Y from the point at which the yarns Y contact with the peripheral surface of the feeding roller 22 are separated from the peripheral surface of the feeding roller 22, to the point at which the yarns Y contact with the peripheral surface of the winding bobbins B. The present preferred embodiment adapts to the increase in winding diameter of the packages 64 by controlling the length of the first free length FL1 to be constant, which will be described in more detail below.

The traverse device 32 is located upstream of the feeding roller 22 with respect to the advance direction of the yarns Y, and is fixed in a position relative to the machine body 12. The traverse device 32 includes traverse guides 34. The traverse guides 34 are driven by a traverse driving motor 320. The traverse guides 34 engaged with the yarns Y fed from an upper portion of FIG. 1 reciprocate within a traverse range to traverse the yarns Y fed to the downstream direction. The traverse driving motor 320 is electrically connected to the control unit 14, hence driving of the traverse driving motor 320 is controlled. Here, the traverse device 32 may be a rotary traverse device using rotating blades or any other well-known traverse device.

The interval between the traverse device 32 and the feeding roller 22 is maintained. The length of the yarns Y which runs through this interval is defined as a second free length FL2. That is to say, as shown in FIGS. 1 and 3, the second free length FL2 is the free length portion of the yarns Y from the point at which the yarns Y engaged to the traverse guides 34 are released from the traverse guides 34, to the point at which the yarns Y contact with the peripheral surface of the feeding roller 22. In the present preferred embodiment, the traverse device 32 and the feeding roller 22 are fixed in positions relative to the machine body 12 so that the second free length FL2 is stable during the package forming period P.

The peripheral speed detection unit 42 detects the peripheral speed of the winding bobbins B. The peripheral speed detection unit 42 of this preferred embodiment preferably includes a contact roller 43. The contact roller 43 is a roller which contacts with the winding bobbins B under a predetermined contact pressure during the package forming period P following the change of the position of the winding bobbins B. The contact roller 43 rotates following the rotation of the winding bobbins B. The contact roller 43 is rotatably supported by arms 44 at a first end portion 441 side. The arms 44 are rockably provided with respect to the machine body 12. In a second end portion 442 side of the arm 44, the interposition of an actuator 46 is connected between the arm 44 and the machine body 12. The actuator 46 is provided to adjust the contact pressure of the contact roller 43 with respect to the winding bobbins B. By the swinging of the arms 44, the contact roller 43 contacts with the winding bobbins B under the predetermined contact pressure following the rotation of the winding bobbins B (Refer to FIGS. 1 and 3). A rotation sensor 48 that detects the rotational speed of the contact roller 43 is provided on the arms 44. The rotation sensor 48 detects the rotational speed of the contact roller 43 which rotates following the rotation of the winding bobbins B, and then, detects the peripheral speed of the winding bobbins B.

The rotation sensors 48 are electrically connected to the control unit 14. The detection signal of the rotation sensors 48 are sent to the control unit 14. The control unit 14 controls driving of the bobbin holder driving motors 180 so as to make uniform the rotational speed detected by the rotation sensors 48. Specifically, if the detected value of the rotation sensors 48 is less than the predetermined value corresponding to the winding speed, the control unit 14 controls the bobbin holder driving motors 180 so as to increase the rotational speed thereof. In an opposite manner, if the detected value is larger than the predetermined value, the control unit 14 controls the bobbin holder driving motors 180 so as to decrease the rotational speed thereof. In addition, the device to detect the peripheral speed of the winding bobbins B is not limited to the contact roller 43. For example, an optical distance sensor may be provided on the turret 16. In this case, the increase in winding diameter of the winding bobbins B can be detected by irradiating the outer periphery of the winding bobbins B. Hence, the peripheral speed of the winding bobbins B may be calculated from the diameter of the winding bobbins B.

Next, an explanation will be given of the control in the spun yarn winding device 100 in the present preferred embodiment. In this preferred embodiment, a basic operation is performed during the packages forming period P, by controlling the rotational angle of the turret 16 so as to maintain the first free length FL1 of the yarns Y positioned between the feeding roller 22 and the winding bobbins B to be equal to a standard length FL11. A program that performs the control is stored in the ROM of the control unit 14 and is executed after loading the program into the RAM.

During the packages forming period P, as the formation of the packages 64 goes on, the winding diameter of the packages 64 is gradually increased. In order to maintain the first free length FL1 at the standard length FL11 corresponding to the increase in winding diameter of the packages 64, it is necessary to gradually extend the distance between the shaft center of the feeding roller 22 and the shaft center of the winding bobbins B. Therefore, the control to rotate the turret 16 by a fine angle corresponding to the increase in winding radius of the packages 64 so as to gradually extend the distance between the shaft center of the feeding roller 22 and the shaft center of the winding bobbins B performs.

The control to rotate the turret 16 by a fine angle corresponding to the increase in winding diameter of the packages 64 is performed as shown below. As shown in FIG. 3, the diameter of the packages 64 at a certain point during the packages forming period P is defined as "r". The rotational angle of the turret 16 from the point at which winding the yarns to the winding tubes 62 is started (Refer to FIG. 1) to a certain point during the package winding period P (Refer to FIG. 3) is defined as θ.

On the basis of the rotation number of the bobbin holder driving motor 180, the rotation number of the contact roller 43, and the winding time detected at a time when an infinitesimal time dt has passed from the point shown in FIG. 3, the control unit 14 calculates an increase in winding diameter dr of the packages 64. On the basis of the calculated increase in winding diameter dr of the packages 64, the control unit 14 calculates a fine rotation angle dθ of the turret 16 which is necessary to maintain the first free length FL1 at the standard length FL11. The control unit 14 is programmed to control the rotation of the turret driving motors 160 so as to further rotate the turret 16 by the fine rotation angle dθ from a rotation angle θ. By repeating such control, the first free length FL1 is maintained at the standard length FL11. In addition, the contact roller 43 is kept in contact with the winding bobbins B under the predetermined contact pressure, following the change of the position of the winding bobbins B caused by the basic operation.

Next, an explanation will be given of the standard length FL11 of the first free length FL1. As shown in FIGS. 1 and 3, the standard length FL11 is the length of the first free length FL1 during the basic operation. During the packages forming period P, the standard length FL11 is maintained at constant length or is gradually changed, depending on the shape of the packages 64 which are formed. For example, in cases where the packages 64 are formed as a cheese-winding packages (where the winding width is constant), as shown in FIG. 4, the standard length FL11 is maintained at a constant length during the package forming period P, and the length of the standard length FL11 is kept as short as possible (for example, about 1 mm to about 2 mm). By maintaining the standard length FL11 at a constant length and maintaining at the standard length FL11 as short as possible, a difference (traverse delay) between an axial direction position where the yarns Y are traversed and an axial direction position where the yarns Y are actually received by the feeding roller 22 is maintained to the minimum. As a result, the winding width of the packages 64 is maintained at a constant winding width.

According to the above-described spun yarn winding device 100 of Preferred Embodiment 1, the following effects can be achieved.

The feeding roller 22 and the traverse device 32 are fixed in a position relative to the machine body 12, and are corresponding to the increase in winding diameter of the packages 64 by rotating the turret 16 by fine angle. Therefore, with no need to provide a movable portion projecting to the vertical direction of the spun yarn winding device 100, it is possible to reduce the size of the spun yarn winding device 100 in a vertical direction. As such, the spun yarn winding device 100 can be compact.

Preferred Embodiment 2

Next, a spun yarn winding device 100 according to Preferred Embodiment 2 of the present invention will be described with reference to FIGS. 5 to 7. Preferred Embodiment 2 differs significantly from Preferred Embodiment 1 in that the spun yarn winding device 100 according to Preferred Embodiment 2 corresponds to the spun yarn winding device 100 according to Preferred Embodiment 1 in which a bulge suppressing mechanism and a saddle bag shape collapsing mechanism are additionally provided. A detailed description of the same components as those of Preferred Embodiment 1 is omitted.

First of all, an explanation will be given of the bulge suppressing mechanism of the spun yarn winding device 100 according to the present preferred embodiment. Because yarn passages of elastic threads tends to be unstable as the winding speed of the yarns increases, high tension is applied to the elastic threads, and then, the elastic threads are wound onto winding bobbins in an extending condition. When the yarns are wound onto the winding bobbins in the extending condition, tensile stress of the yarns accumulates in the inner portion of packages. Since tightening forces of the yarns due to the accumulation of the tensile stress is enormously powerful, a bulge winding phenomenon and fixation between yarns tend to occur. The bulge winding phenomenon is a phenomenon in which sides of the packages become bulged in convex projection due to the tightening forces of the wound yarns, and thus, the appearance of the package form becomes worse.

In this preferred embodiment, the rotational speed of the feeding roller 22 is a speed at which the yarns Y are fed to the winding bobbins B which is faster than the speed at which the yarns Y are wound onto the winding bobbins B. The speed at which the feeding roller 22 feeds the yarns Y is determined by a characteristic, etc. of the yarns Y. However, the speed at which the feeding roller 22 feeds the yarns Y is preferably about 1.1 or more times of the speed at which the yarns Y are wound onto the winding bobbins B, for example.

By feeding the yarns Y to the winding bobbins B by the feeding roller 22 at a speed faster than the winding speed at which the yarns Y are wound onto the winding bobbins B, the tensile stresses of the yarns Y are eased just before the winding bobbins B. Therefore, the tightening forces of the yarns Y which impinge on the packages 64 inner can be eased, and hence the bulge winding phenomenon and fixation between yarns are prevented.

Next, an explanation will be given of the saddle bag shape collapsing mechanism of the spun yarn winding device 100 according to the present preferred embodiment. The saddle bag shape collapsing mechanism of the present preferred embodiment controls the first free length FL1 of the yarns Y which is located between the feeding roller 22 and the winding bobbins B during the package forming period P so as to solve the saddle bag shape phenomenon of the packages 64. Specifically, the basic operation and changing operation are repeated during the package forming period P by controlling the rotational angle of the turret 16. During the basic operation, the first free length FL1, which is located between the feeding roller 22 and the winding bobbins B, of the yarns Y, is maintained at the standard length FL11. Meanwhile, during the changing operation, the first free length FL1 is temporarily increased larger than the standard length FL11.

A program that performs the control is stored in the ROM of the control unit 14 and executed after loading the program into the RAM. Here, a period during which the basic operation for maintaining the first free length FL1 at the standard length FL11 is performed is defined as a period F1, whereas a period during which the changing operation to temporarily increases the first free length FL1 larger than the standard length FL11 is performed is defined as a period F2 (Refer to FIG. 6).

First of all, an explanation will be given of the basic operation during which the first free length FL1 of the yarns Y which are located between the feeding roller 22 and the winding bobbins B, is maintained at the standard length FL11. As shown in FIG. 6, the period during which the basic operation is performed is defined as the period F1. During the period F1, the first free length FL1 is maintained at the standard length FL11. During the packages forming period P, the packages 64 is gradually increased in winding diameter as the formation of the packages 64 proceeds. The specific control of the basic operation during which the first free length FL1 is maintained at the standard length FL11 corresponding to the increase in winding radius of the packages 64 is the same as that of Preferred Embodiment 1. Then, a detailed explanation is omitted.

Next, an explanation will be given of the changing operation during which the first free length FL1 is temporarily increased larger than the standard length FL11. As shown in FIG. 6, control to temporarily increase the first free length FL1 without relation to the size of the packages 64 at the time is performed during the changing operation. That is to say, the control to increase the first free length FL1 and then decrease the first free length FL1 to return to the standard length FL11 is performed.

Figure 5:
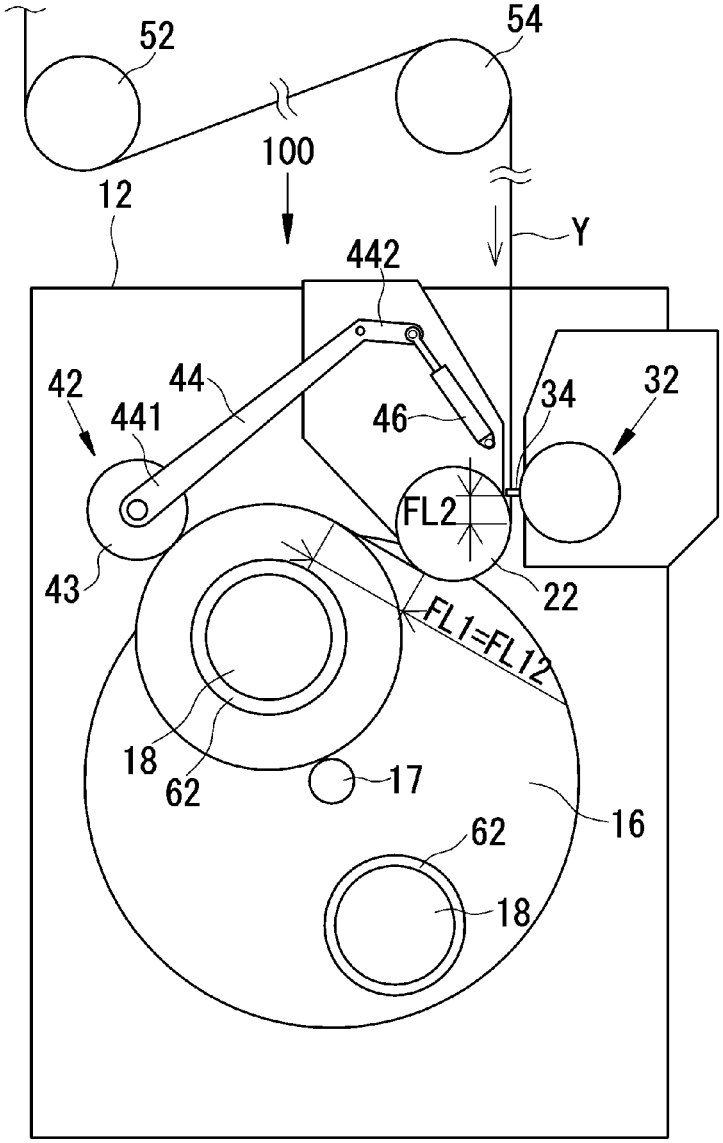
FIG. 5 is a front view showing a state performing a changing operation which temporarily increases the first free length FL1 up to FL12.

As shown in FIG. 5, during the changing operation, the turret 16 is temporarily rotated largely compared to that of in the state of the basic operation so as to temporarily increase the first free length F1. Therefore, the distance between the shaft center of the feeding roller 22 and the shaft center of the winding bobbins B is enlarged compared to that of in the basic operation. As shown in FIG. 6, during the changing operation of the present preferred embodiment, the first free length FL1 is temporarily enlarged up to FL12, which is longer than the standard length FL11.

After enlarging the first free length FL1 up to FL12 which is larger than the standard length FL11, the turret 16 is then rotated backward so as to return the rotational angle of the turret 16 to the state of the basic operation. As such, the first free length FL1 returns back to the standard length FL11, and then, the changing operation is terminated. The contact roller 43 is kept in contact with the winding bobbins B under the predetermined contact pressure following the change of the position of the winding bobbins B caused by the changing operation.

Figure 7:
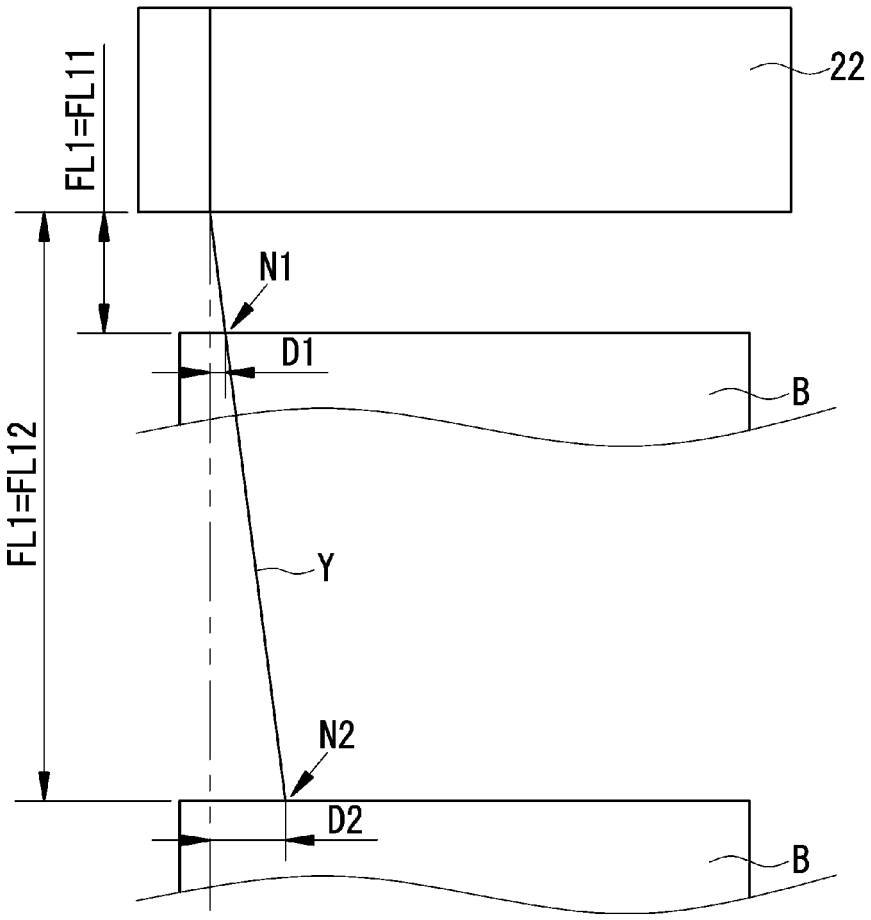
FIG. 7 is a figure showing the relation between the first free length FL1 and a traverse delay.

As shown in FIG. 7, this changing operation is a control to enlarge the distance between an axial position of the yarns Y in the feeding roller 22 and an axial position where the yarns Y are wound onto the winding bobbins B. That is to say, a traverse delay D1 is temporarily increased up to a traverse delay D2. That is to say, when the first free length FL1 is equivalent to FL11, the yarns Y are wound onto the winding bobbins B at an axial position N1, and the traverse delay at this time is D1. Meanwhile, when the turret 16 is rotated and the first free length FL1 is equivalent to FL12, the yarns Y are wound onto the winding bobbins B at an axial position N2, and the traverse delay at this time is D2.

Due to the difference in traverse delay (D2−D1), even when the yarns Y reach an end of the traverse range of the feeding roller 22, the yarns Y are actually wound around the winding bobbins B at a position closer to the axial center thereof by a distance corresponding to the difference in traverse delay (D2−D1). That is to say, by rotating the turret 16 to temporarily increase the first free length FL1 from FL11 to FL12, the axial winding width is temporarily reduced over which the yarns Y are wound around the winding bobbins B.

Figure 6:
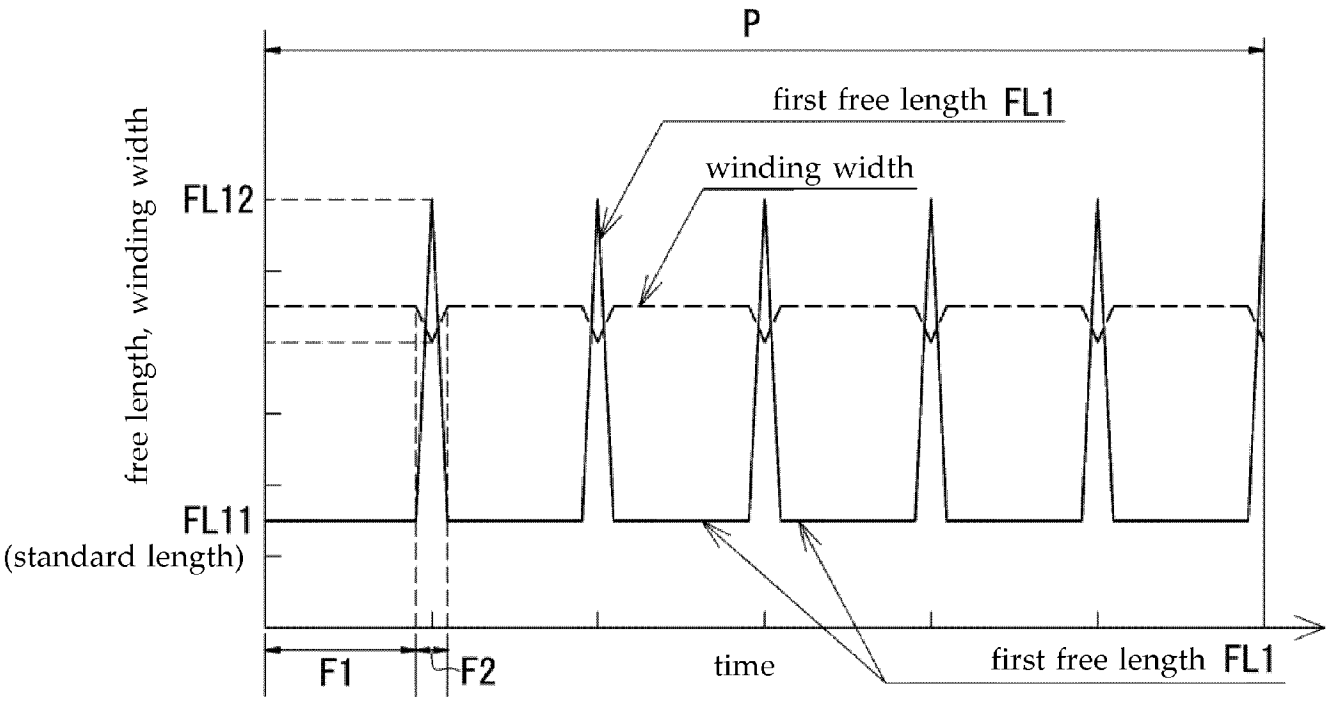
FIG. 6 is a graph showing the relation between winding width and time when the basic operation and the changing operation are repeated.

Then, as shown in FIG. 6, the basic operation and the changing operation are repeated during the package forming period P. Thus, although the winding during the period F1 of the basic operation allows the yarns Y to be wound to ends of the winding bobbins B, the winding during the period F2 of the changing operation reduces the winding width to allow the yarns Y to be wound around the winding bobbins B at a position closer to the axial center thereof.

According to the above-described spun yarn winding device 100 of Preferred Embodiment 2, the following effects can be achieved.

The feeding roller 22 and the traverse device 32 are fixed in position relative to the machine body 12. And conventionally, the turret 16 is structured to rotate relative to the machine body 12. Therefore, the feeding roller 22 and the traverse device 32 provide a simple and highly reliable structure, and simultaneously, the saddle bag shape phenomenon of the packages 64 can be solved. Also, the bulge winding phenomenon of the packages 64 can simultaneously be solved since the feeding roller 22 feeds the yarns to the winding bobbins B at a speed faster than the winding speed at which the yarns Y are wound onto the winding bobbins B.

Preferred Embodiment 3

Next, a spun yarn winding facility 200 according to Preferred Embodiment 3 of the present invention is described with reference to FIG. 8. The spun yarn winding facility 200 of the present preferred embodiment preferably includes the combination of the plurality of spun yarn winding devices 100 which are described in Preferred Embodiment 1 wherein some of the plurality of spun yarn winding devices 100 are located on an upper stage and others of the plurality of spun yarn winding devices 100 are located on a lower stage. Detailed explanation with regard to the spun yarn winding device 100 is omitted.

Figure 8:
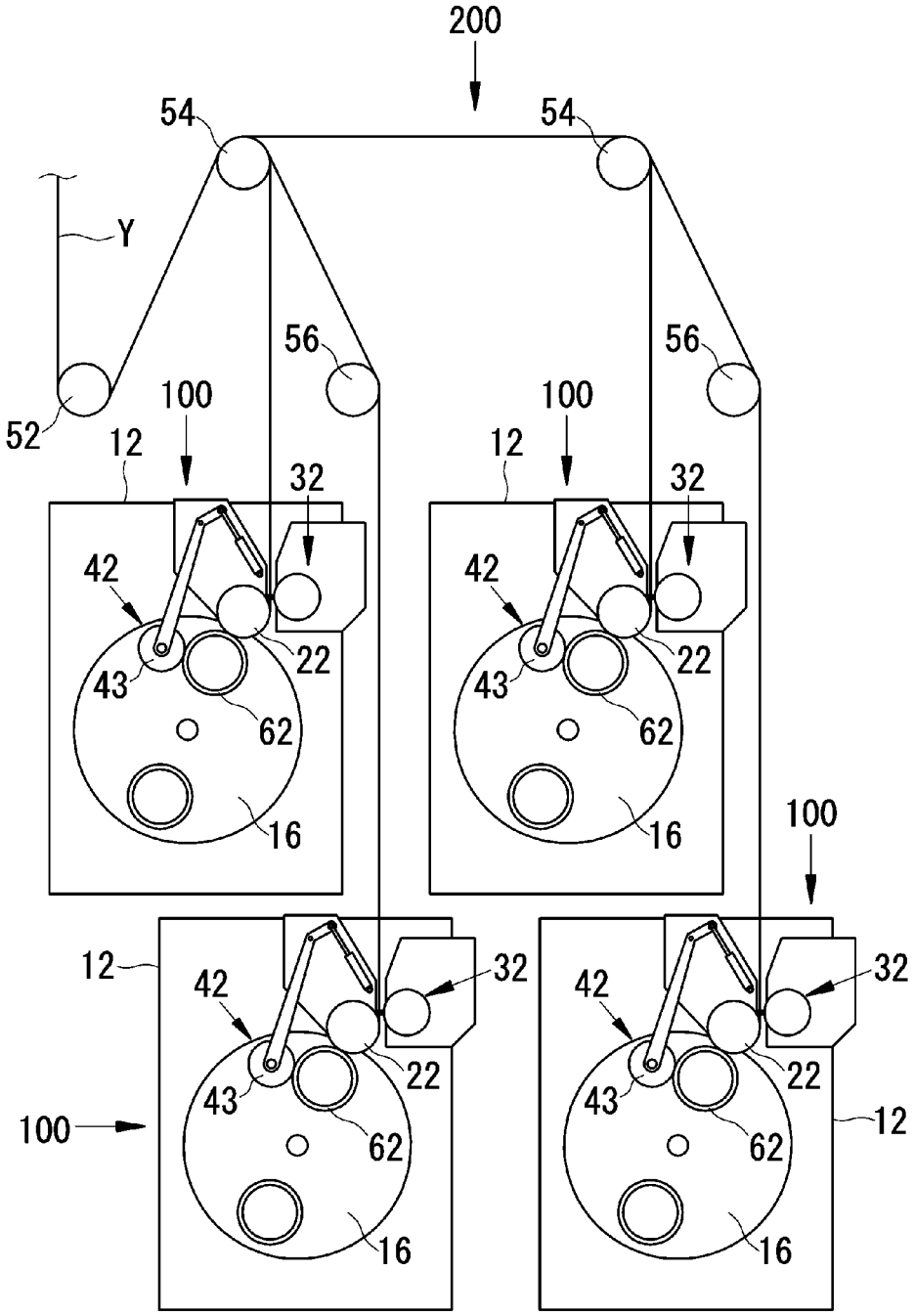
FIG. 8 is a front view showing the layout of a spun yarn winding facility 200 according to Preferred Embodiment 2 of the present invention.

As shown in FIG. 8, with regard to the spun yarn winding facility 200 of the present preferred embodiment, the spun yarn winding devices 100 are located on both the upper and lower stages in a state of a longitudinal layout. The yarns Y are spun at a spinning device (not shown in Figures) which is disposed at an upper portion and then fed to each spun yarn winding device 100 through the intermediary of the roller 52, and the rollers 54, 56, etc. The yarns Y are fed to the traverse devices 32 of each spun yarn winding devices 100 from the upper portion to the lower portion.

When the spun yarn winding facility 200 includes the combination of the plurality of spun yarn winding devices 100 wherein the spun yarn winding devices 100 are placed both the upper and lower stages in a state of a longitudinal layout, it is necessary to prevent interference between the yarns Y fed to the spun yarn winding devices placed on the lower stage and the spun yarn winding devices placed on the upper stage. With regard to the spun yarn winding facility 200 of the present preferred embodiment, in order to prevent the interference of the yarns Y, the spun yarn winding devices 100 located on the lower stage and the spun yarn winding devices 100 located on the upper stage are arranged in a zigzag pattern as seen from the side. That is to say, each yarn Y fed to the spun yarn winding devices 100 which are located on lower stage passes between the plurality of spun yarn winding devices 100 which are located on upper stage, and then fed to the traverse devices 32 from an upper portion.

According to the above-described spun yarn winding facility 200 of Preferred Embodiment 3, the following effects can be achieved.

Generally, when the spun yarn winding facility 200 includes the combination of the plurality of spun yarn winding devices 100 wherein the spun yarn winding devices 100 are arranged on both the upper and lower stages in a state of a longitudinal layout, and the spun yarn winding facility 200 is configured so that the yarns Y are fed to each of the traverse devices 32 of the spun yarn winding devices 100 from the upper portion, the height of the spun yarn winding facility 200 becomes higher, and the excess height causes the problem of the increase in size of the spun yarn winding facility 200. And when the height of the spun yarn winding facility 200 becomes higher, particularly the workability for the spun yarn winding devices 100 which are located on the upper stage is impaired. For this reason, conventionally, locating the spun yarn winding devices 100 on both the upper and lower stages in a state of a longitudinal layout is difficult to adopt.

However, as already described in Preferred Embodiment 1, the spun yarn winding devices 100 which constitute the spun yarn winding facility 200 of the present preferred embodiment are compacted in a vertical direction. As such, even if the plurality of spun yarn winding devices 100 is stacked in the up/down direction in multiple stages in a state of a longitudinal layout, the height of the spun yarn winding facility 200 can be compacted in a vertical direction. Particularly, the workability for the spun yarn winding devices 100 which are located on the upper stage is improved. For this reason, without impairing the workability, the plurality of spun yarn winding devices 100 can be stacked in the up/down direction in multiple stages in a state of a longitudinal layout. As such, the space is effectively utilized.

Preferred Embodiment 4

Next, a spun yarn winding facility 300 according to Preferred Embodiment 4 of the present invention is described with reference to FIG. 9. A spun yarn winding facility 300 of the present preferred embodiment preferably includes the combination of the plurality of spun yarn winding devices 100 which are described in Preferred Embodiment 1 wherein some of the plurality of spun yarn winding devices 100 are located on upper stage and others of the plurality of spun yarn winding devices 100 are located on lower stage. Detailed explanation with regard to the spun yarn winding device 100 is omitted.

Figure 9:
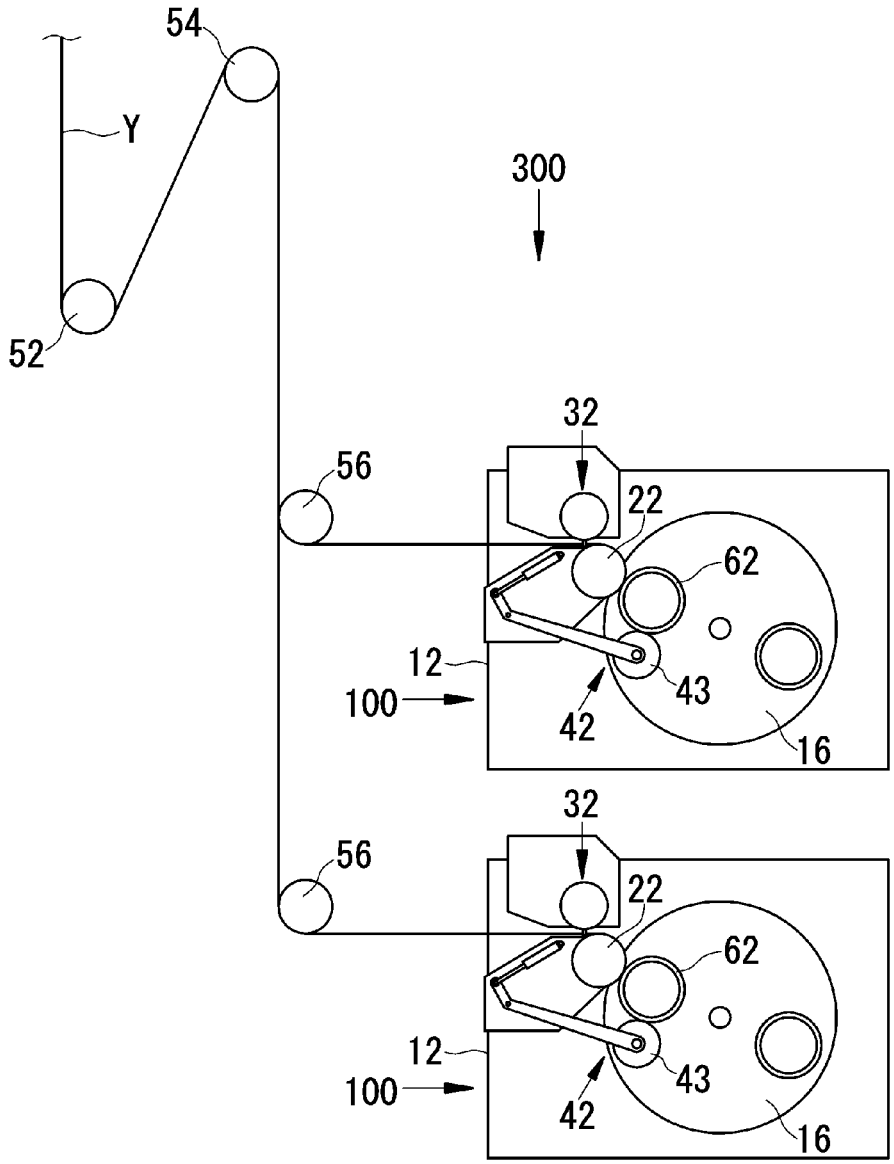
FIG. 9 is a front view showing the layout of a spun yarn winding facility 300 according to Preferred Embodiment 3 of the present invention.

As shown in FIG. 9, with regard to the spun yarn winding facility 300 of the present preferred embodiment, the spun yarn winding devices 100 are arranged on both the upper and lower stages in a state of a horizontal layout. The yarns Y are spun at the spinning device (not shown in Figures) which is disposed at the upper portion and then fed to each spun yarn winding device 100 through the intermediary of the rollers 52, 54, 56, etc. The running direction of the yarns Y is changed at the roller 56, and then the yarns Y are fed to the traverse device 32 of each spun yarn winding device 100 from the side portion.

According to the above-described spun yarn winding facility 300 of Preferred Embodiment 4, the following effects can be achieved.

Generally, when the spun yarn winding facility 300 includes the combination of more than one spun yarn winding devices 100 wherein the spun yarn winding devices 100 are located on both the upper and lower stages in a state of a horizontal layout, and the spun yarn winding facility is configured so that the yarns Y are fed to each of the traverse devices 32 of the spun yarn winding devices 100 from the side portion, the horizontal width of the spun yarn winding facility 300 becomes widened, and the excess horizontal width causes increase in size of the spun yarn winding facility 300 in a horizontal direction. As the horizontal width of the spun yarn winding facility 300 becomes widened, the working space which is necessary between adjacent spun yarn winding devices 300 becomes small, and workability for the spun yarn winding device 100 becomes deteriorated.

However, as already described in Preferred Embodiment 1, the spun yarn winding devices 100 which constitute the spun yarn winding facility 300 of the present preferred embodiment are compacted in a vertical direction. As such, even if the plurality of spun yarn winding devices 100 is stacked in the up/down direction in multiple stages in a state of a horizontal layout, the spun yarn winding facility 300 can be compacted in the horizontal direction. For this reason, the working space which is necessary between adjacent spun yarn winding devices 300 is ensured, and the workability for the spun yarn winding devices 100 can be improved. For this reason, without impairing the workability, the plurality of spun yarn winding devices 100 can be stacked in the up/down direction in multiple stages in a state of a horizontal layout. As such, the space can be utilized effectively.

The spun yarn winding device according to various preferred embodiments of the present invention is useful and advantageous because of a significant reduction in vertical length. And the spun yarn winding facility including the combination of the plurality of spun yarn winding devices according to preferred embodiments of the present invention is also useful and advantageous because the plurality of spun yarn winding devices can be vertically stacked in multiple stages without impairing the workability and thus space can be utilized effectively.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A spun yarn winding device for winding spun yarns onto winding bobbins, the spun yarn winding device comprising:

a machine body;

a turret including bobbin holders that hold the winding bobbins and which is rotatable with respect to the machine body;

a feeding roller that is fixed in position relative to the machine body, is not in contact with the winding bobbins, and feeds yarns to the winding bobbins at a speed equal to or faster than a speed at which the yarns are wound on the winding bobbins;

a traverse device which is fixed in position upstream of the feeding roller with respect to an advance direction of the yarns and which traverses the yarns;

a peripheral speed detection unit that detects a peripheral speed of the winding bobbins; and a control unit that is programmed to, during a yarn winding period, perform a basic operation to maintain a free length of the yarns at a standard length by controlling a rotational angle of the turret, the free length being lengths of portions of the yarns which are located between the feeding roller and the winding bobbins.

2. The spun yarn winding device according to claim 1, wherein the feeding roller feeds yarns to the winding bobbins at a speed faster than the speed at which the yarns are wound on the winding bobbins;

the control unit repeats the basic operation and a changing operation during the yarn winding period; wherein the changing operation temporarily increases the length of the free length to be longer than that of the standard length.

3. The spun yarn winding device according to claim 2, wherein the peripheral speed detection unit comprises a contact roller which contacts the winding bobbins with a predetermined contact pressure following a change of position of the winding bobbins.

4. The spun yarn winding device according to claim 1, wherein the peripheral speed detection unit comprises a contact roller which contacts with the winding bobbins under a predetermined contact pressure following a change of position of the winding bobbins.

5. A spun yarn winding facility comprising:

a plurality of spun yarn winding devices according to claim 1 provided on an upper stage and a lower stage; wherein each one of yarns fed to the spun yarn winding devices located on the lower stage passes between the plurality of spun yarn winding devices located on the upper stage, and is fed to the traverse device from above.

6. A spun yarn winding facility comprising:

a plurality of spun yarn winding devices according to claim 1 provided on an upper stage and a lower stage; wherein each one of yarns fed to the spun yarn winding devices located on the upper stage and the lower stage is fed to the traverse device from a side.

7. A spun yarn winding facility comprising:

a plurality of spun yarn winding devices according to claim 2 provided on an upper stage and a lower stage; wherein each one of yarns fed to the spun yarn winding devices located on the lower stage passes between the plurality of spun yarn winding devices located on the upper stage, and is fed to the traverse device from above.

8. A spun yarn winding facility comprising:

a plurality of spun yarn winding devices according to claim 2 provided on an upper stage and a lower stage; wherein each one of yarns fed to the spun yarn winding devices located on the upper stage and the lower stage is fed to the traverse device from a side.

9. A spun yarn winding facility comprising:

a plurality of spun yarn winding devices according to claim 3 provided on an upper stage and a lower stage; wherein each one of yarns fed to the spun yarn winding devices located on the lower stage passes between the plurality of spun yarn winding devices located on the upper stage, and is fed to the traverse device from above.

10. A spun yarn winding facility comprising:

a plurality of spun yarn winding devices according to claim 3 provided on an upper stage and a lower stage; wherein each one of yarns fed to the spun yarn winding devices located on the upper stage and the lower stage is fed to the traverse device from a side.

11. A spun yarn winding facility comprising:

a plurality of spun yarn winding devices according to claim 4 provided on an upper stage and a lower stage; wherein each one of yarns fed to the spun yarn winding devices located on the lower stage passes between the plurality of spun yarn winding devices located on the upper stage, and is fed to the traverse device from above.

12. A spun yarn winding facility comprising:

a plurality of spun yarn winding devices according to claim 4 provided on an upper stage and a lower stage; wherein each one of yarns fed to the spun yarn winding devices located on the upper stage and the lower stage is fed to the traverse device from a side.

* * * * *